US008991228B2

(12) United States Patent
Yang

(10) Patent No.: US 8,991,228 B2
(45) Date of Patent: Mar. 31, 2015

(54) OUTER SHELL MEMBER POSITIONING DEVICE

(71) Applicant: Chenbro Micom Co., Ltd., New Taipei (TW)

(72) Inventor: Cheng-Feng Yang, Keelung (TW)

(73) Assignee: Chenbro Micom Co., Ltd., New Taipei (TW)

( * ) Notice: Subject to any disclaimer, the term of this patent is extended or adjusted under 35 U.S.C. 154(b) by 0 days.

(21) Appl. No.: 13/906,990

(22) Filed: May 31, 2013

(65) Prior Publication Data

US 2014/0013811 A1 Jan. 16, 2014

(30) Foreign Application Priority Data

Jul. 10, 2012 (TW) ..... 101213322 A

(51) Int. Cl.
*E05B 13/00* (2006.01)
*E05B 65/00* (2006.01)

(52) U.S. Cl.
CPC ..... *E05B 65/006* (2013.01)
USPC ..... 70/208; 70/145; 292/336.3

(58) Field of Classification Search
USPC ..... 70/144, 145, 208, 210; 292/173, 336.3
See application file for complete search history.

(56) References Cited

U.S. PATENT DOCUMENTS

| | | | | | |
|---|---|---|---|---|---|
| 4,683,736 | A * | 8/1987 | Weinerman et al. | ..... | 70/208 |
| 5,469,725 | A * | 11/1995 | Yamada | ..... | 70/208 |
| 5,638,709 | A * | 6/1997 | Clavin | ..... | 70/208 |
| 5,974,842 | A * | 11/1999 | Schlack et al. | ..... | 70/208 |
| 6,023,953 | A * | 2/2000 | Vickers et al. | ..... | 70/208 |
| 6,174,007 | B1 * | 1/2001 | Schlack et al. | ..... | 70/208 |
| 6,427,501 | B2 * | 8/2002 | Ramsauer | ..... | 70/208 |
| 6,553,796 | B2 * | 4/2003 | Finch | ..... | 70/208 |
| 6,606,889 | B1 * | 8/2003 | Tweedy | ..... | 70/208 |
| 6,918,274 | B2 * | 7/2005 | Gladden et al. | ..... | 70/208 |

* cited by examiner

*Primary Examiner* — Christopher Boswell
(74) *Attorney, Agent, or Firm* — Muncy, Geissler, Olds & Lowe, P.C.

(57) ABSTRACT

An outer shell member positioning device includes a mounting base member mounted at an outer shell member, a bracket pivotally coupled to the mounting base member and biasable between a first position where constraint bars of the bracket are engaged in a locating hole of an inner shell member to stop the inner shell member in place and a second position where the inner shell member is released from the constraint of the constraint bars and movable out of the outer shell member, a sliding hook member mounted in one end of the bracket and hookable to the mounting base member to secure the bracket in the first position, and a locking device mounted in the bracket and operable to lock the sliding hook member to the mounting base member.

8 Claims, 8 Drawing Sheets

OUTER SHELL MEMBER POSITIONING DEVICE

This application claims the priority benefit of Taiwan patent application number 101213322, filed on Jul. 10, 2012.

BACKGROUND OF THE INVENTION

1. Field of the Invention

The present invention relates to shell member mounting technology and more particularly, to an outer shell member positioning device, which comprises a mounting base member mounted at an outer shell member, a bracket pivoted to the mounting base member and engageable into a locating hole of an inner shell member to stop the inner shell member inside the outer shell member in place, a sliding hook member slidably mounted in one end of the bracket and hookable in a retaining hole of the mounting base member to hold the bracket in engagement with the inner shell member, and a locking device mounted in the bracket for locking the sliding hook member.

2. Description of the Related Art

As the coming of the information era, various electronic products have entered our life. With the continuous development of innovation technology, electronic hardware equipments are created having versatile functions for multipurpose applications. Most electronic products use a computer to control or execute the operation. In consequence, computer plays an important role in many different fields. In order to enhance the operating speed, a computer server or industrial computer server may be expanded to provide a large number of hard disk drives, multimedia players, DVD-RW drivers, and other peripheral apparatuses.

Further, an industrial computer server has multiple racks mounted in the server case thereof to hold motherboards, hard disk drives, fan modules, power supply device and many other component parts. To facilitate maintenance and replacement of component parts, the server cases or outer shell members of regular computer servers are commonly made detachable. According to conventional techniques, a server case or outer shell member of a computer server or electronic equipment has slidable hook members provided at two opposite lateral sides thereof for hooking in the internal racks or inner shell members of the server or electronic equipment. The use of sliding hook members facilitates mounting and dismounting of the server case or outer shell member. However, this sliding hook design has low stability. The sliding hook members can be forced out of the hooked position accidentally during delivery of the server or electronic equipment. Further, due to lack of anti-theft measures, an evil person can easily open the server case or outer shell member of the server or electronic equipment to steal the internal electronic component parts or storage data of the server or electronic equipment.

SUMMARY OF THE INVENTION

The present invention has been accomplished under the circumstances in view. It is therefore the main object of the present invention to provide an outer shell member positioning device, which comprises a mounting base member, which is mounted at an outer shell member and which comprises two pivot holders located at one end thereof and holding a pivot pin therebetween and a retaining hole located at an opposite end thereof, a bracket, which comprises two constraint bars obliquely disposed at one end there and pivotally coupled to the pivot pin of the mounting base member for engaging into a locating hole in an inner shell member to secure the outer shell member to the inner shell member and box track disposed at an opposite end thereof, a spring-loaded sliding hook member, which comprises two forwardly extending first hook bars slidably hooked in respective sliding slots in two opposite lateral sides of the box track and a downwardly extending second hook bar for hooking in the retaining hole of the mounting base member to hold the bracket in an accommodation open chamber inside the mounting base member, and a locking device mounted in the bracket for locking the sliding hook member in the hooked position to provide an anti-theft effect.

According to another aspect of the present invention, when the locking device is rotated with the key to move a locking latch thereof from the locking position to the unlocking position, the sliding hook member is released from the constraint of the locking latch and can be moved in the box track to compress the loaded spring thereof and to disengage its second hook bar from the retaining hole of the mounting base member, allowing the bracket to be turned about the pivot pin to the outside of the accommodation open chamber of the mounting base member to release the inner shell member from the constraint of the constraint bars of the bracket. At this time, the outer shell member can be removed from the inner shell member. Thus, the outer shell member positioning device has a high level of structural stability and facilitates operation.

According to still another aspect of the present invention, when the outer shell member is mounted to the inner shell member, the user simply needs to bias the bracket toward the inside of the accommodation open chamber of the mounting base member to force the constraint bars into engagement with the locating hole of the inner shell member. At this time, the second hook bar of the sliding hook member will be automatically forced into engagement with the retaining hole of the mounting base member to secure the bracket positively in position, and the constraint bars of the bracket are prohibited from being forced out of the locating hole of the inner shell member by a shearing force as the outer shell member is being pulled accidentally by an external force.

According to still another aspect of the present invention, when the locking device is rotated to the locking position with the key, the locking latch of the locking device is stopped against the base plate of the sliding hook member to prohibit movement of the sliding hook member toward the inside of the box track of the bracket, keeping the second hook bar of the sliding hook member in positive engagement with the retaining hole of the mounting base member, assuring a high level of security.

DETAILED DESCRIPTION OF THE PREFERRED EMBODIMENT

Figure 1:
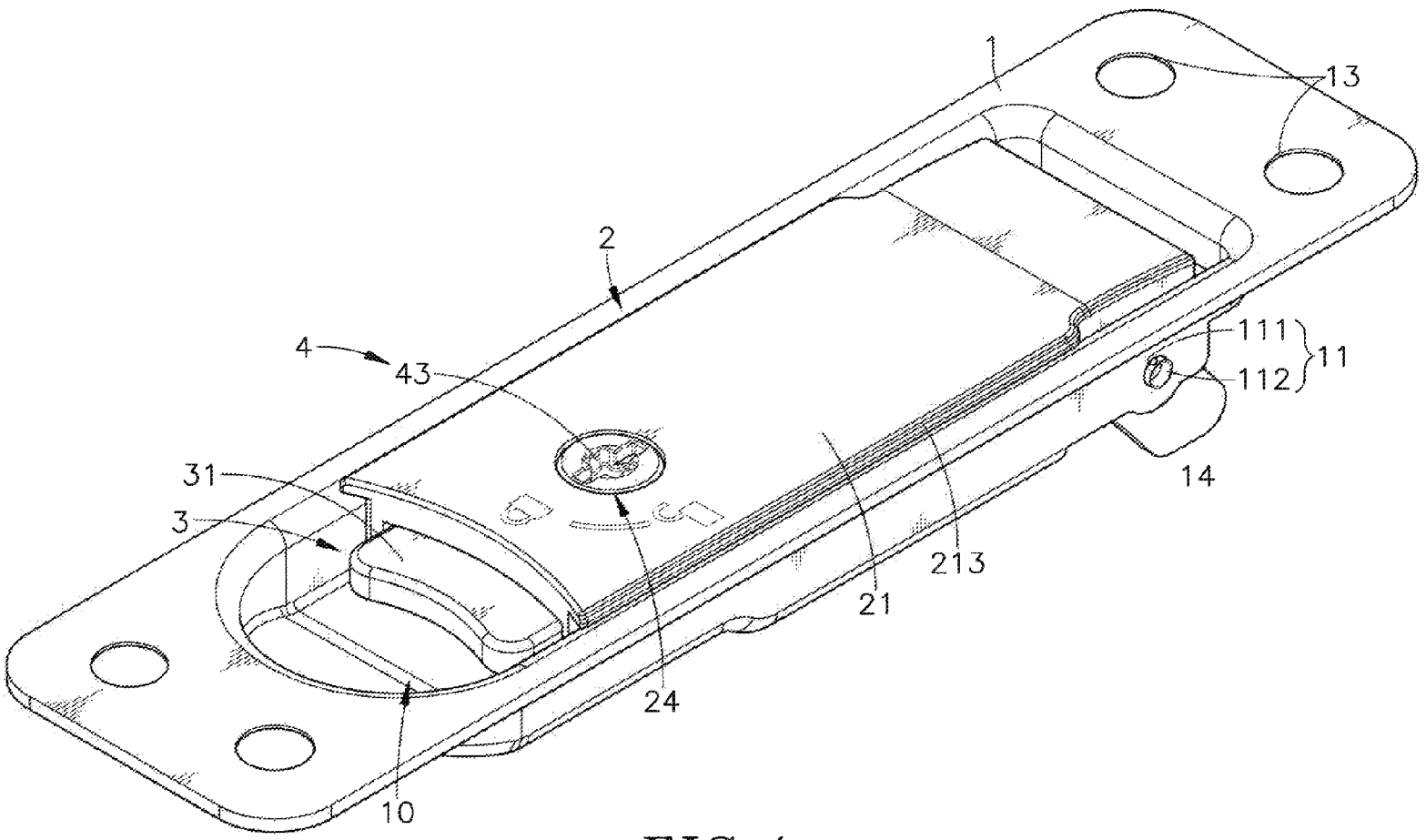
FIG. 1 is an oblique top elevational view of an outer shell member positioning device in accordance with the present invention.
Figure 2:
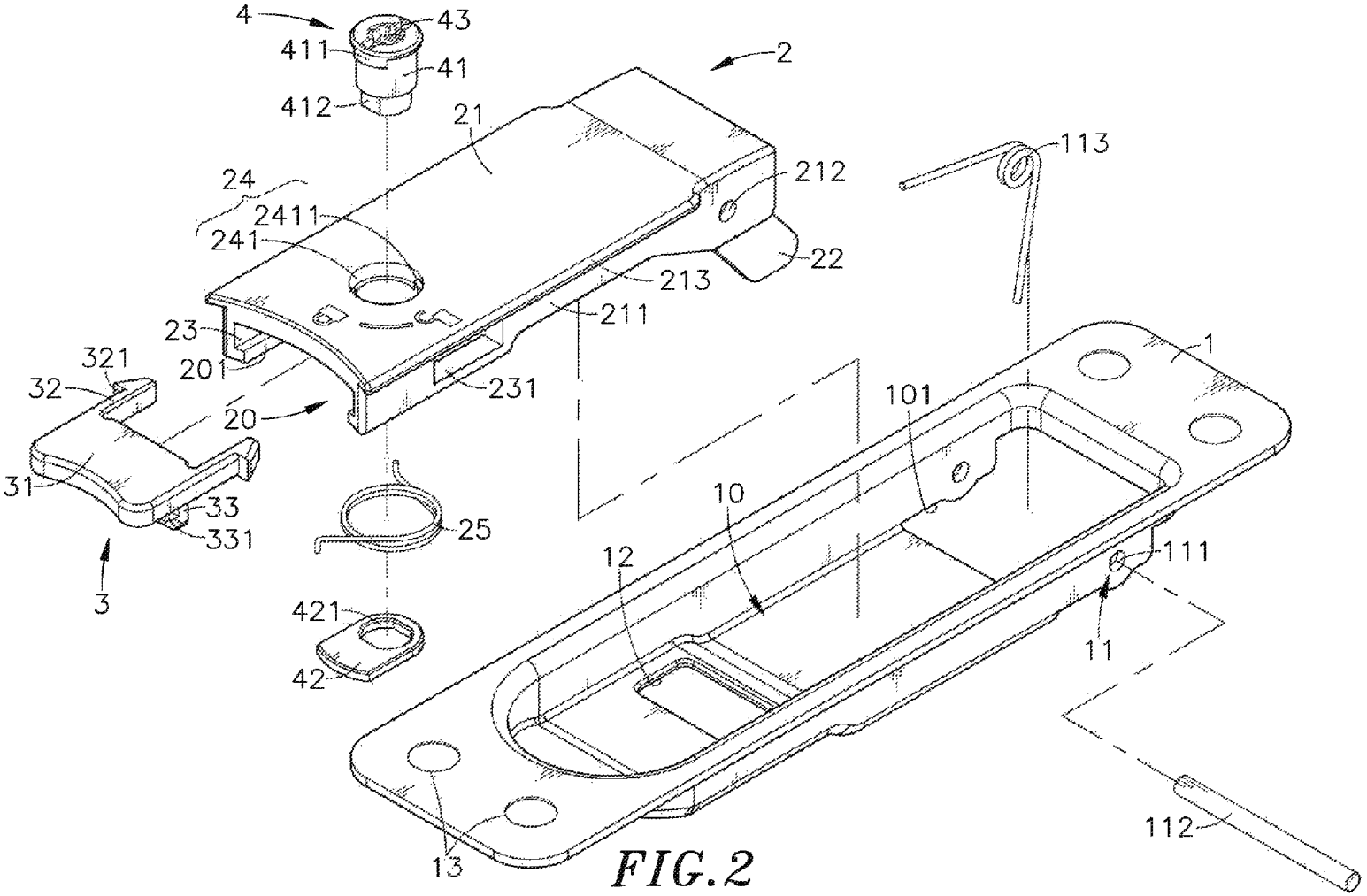
FIG. 2 is an exploded view of the outer shell member positioning device in accordance with the present invention.
Figure 3:
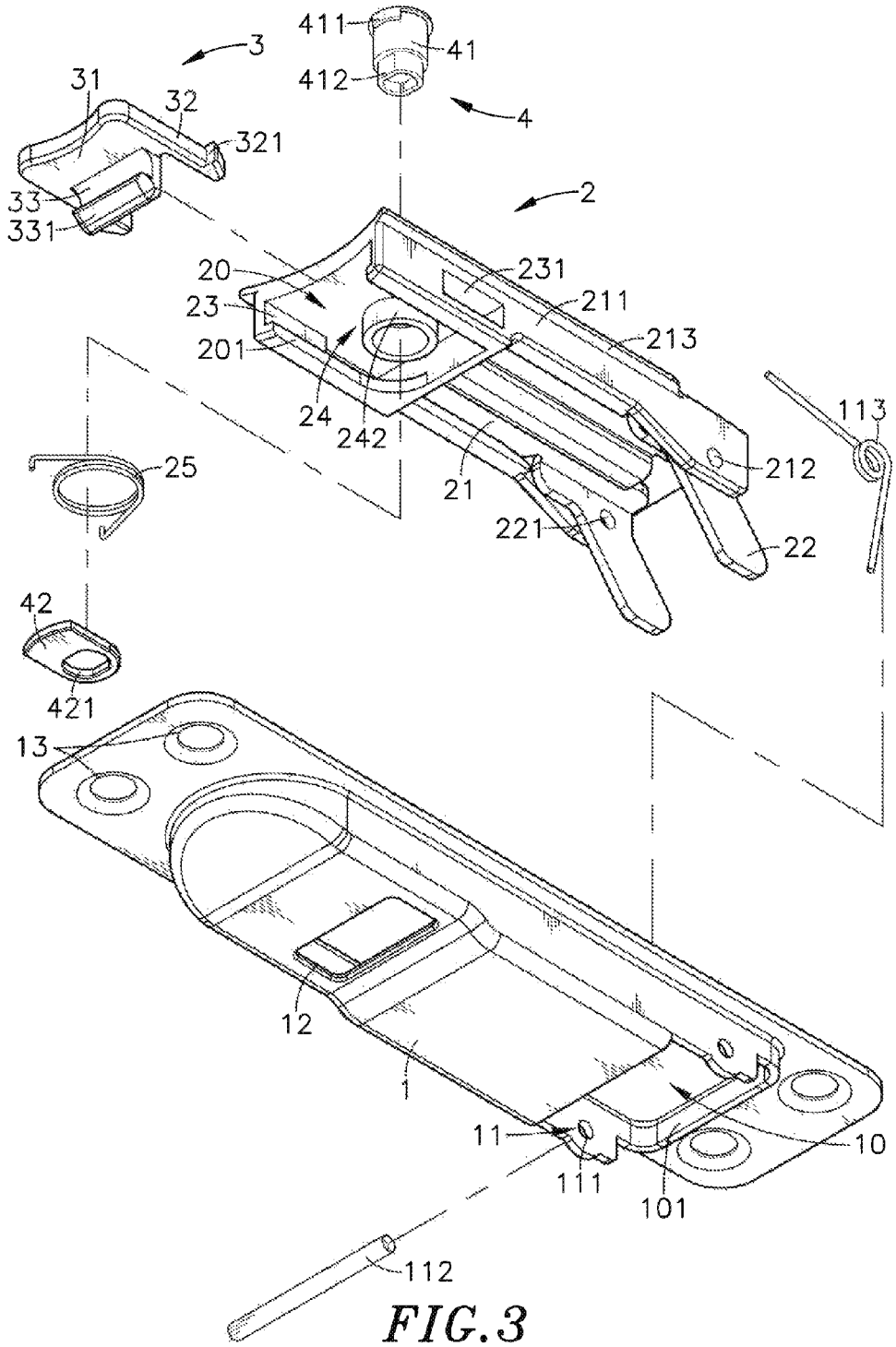
FIG. 3 corresponds to FIG. 2 when viewed from another angle.
Figure 4:
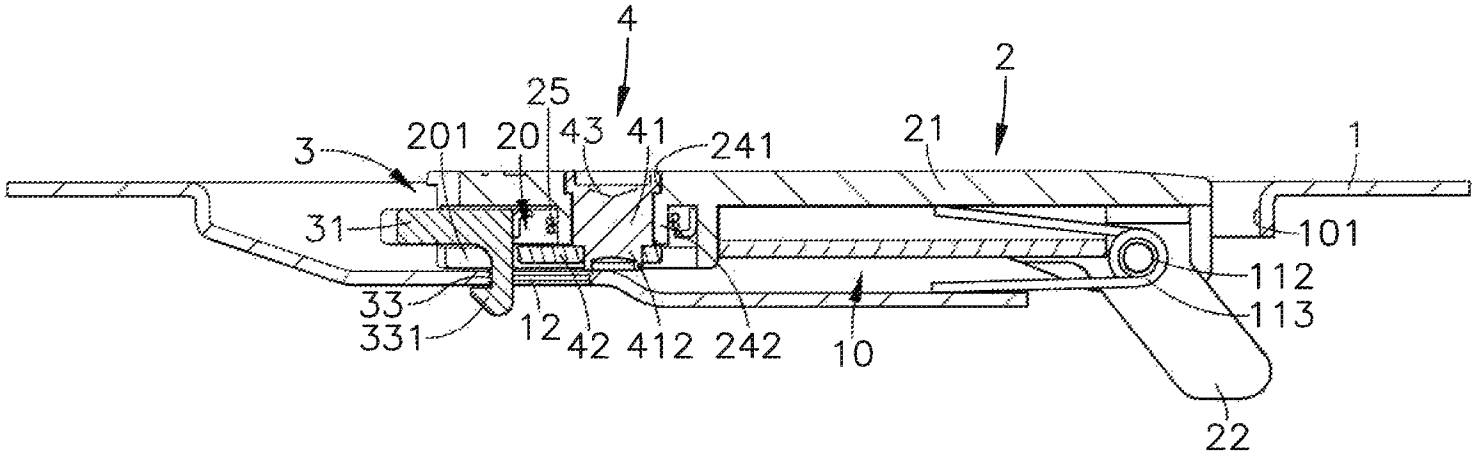
FIG. 4 is a sectional side view of the outer shell member positioning device in accordance with the present invention.

Referring to FIGS. 1-4, an outer shell member positioning device in accordance with the present invention is shown. The outer shell member positioning device comprises a mounting base member 1, a bracket 2, a sliding hook member 3, and a locking device 4.

The mounting base member 1 defines an elongated accommodation open chamber 10, an opening 101 cut through a bottom wall thereof and disposed in communication with one end of the accommodation open chamber 10, pivoting means, for example, two pivot holders 11 downwardly extended from the bottom wall and arranged at two opposite lateral sides of the first opening 101 in a parallel manner and defining therein a respective pivot hole 111, a pivot pin 112 inserted into the pivot holes 111 of the pivot holders 11, a torsion spring 113 mounted on the pivot pin 112, a retaining hole 12 cut through the bottom wall and disposed in communication with an opposite end of the accommodation open chamber 10, and mounting portions, for example, mounting through holes 13 disposed around the border area thereof.

The bracket 2 comprises a base panel 21, two side panels 211 respectively downwardly extended from the bottom wall of the base panel 21 and symmetrically disposed at two opposite lateral sides, two pivot holes 212 respectively located in the side panels 211 near respective rear ends of the side panels 211, two opposing constraint bars 22 obliquely downwardly extended from the base panel 21 and defining therein a respective axle hole 221 in axial alignment with the pivot holes 212, a box track 23 formed integral with the bottom wall of the base panel 21 and respective front parts of the side panels 211 remote from the constraint bars 22, a sliding space 20 defined in the box track 23, a bottom opening 201 cut through a bottom wall of the box track 23 in communication with the sliding space 20, two elongated sliding slots 231 respectively formed in two opposite lateral sides of the box track 23, a positioning hole 24 vertically cut through the base panel 21 in communication with the sliding space 20 and defining therein two stop edges 2411 and a circularly arched sliding way 241 between the two stop edges 2411, a stub tube 242 perpendicularly extended from the bottom wall of the base panel 21 around the positioning hole 24 and suspending in the sliding space 20, and a spring member, for example, coiled spring 25 mounted around the stub tube 242.

Further, the constraint bars 22 can be formed integral with the base panel 21 by insert molding. Alternatively, the constraint bars 22 can be separately made and then fastened to the base panel 21 by means of a plug joint, or any of a variety of known fastening techniques.

The sliding hook member 3 comprises a base plate 31, two first hook bars 32 respectively and forwardly extended from two opposite lateral sides of the base plate 31 in a horizontal direction and respectively terminating in a respective hooked tip 321, and a second hook bar 33 downwardly extended from a front side of the base plate 31 between the first hook bar 32 and terminating in a hooked tip 331. Thus, the first hook bars 32 and the second hook bar 33 are arranged at right angle.

The locking device 4 comprises a lock cylinder 41 defining a keyway 43 on a top side thereof, a stop block 411 at the periphery thereof near the top side and a locating shank 412 at a bottom side thereof, and a locking latch 42 that defines a mounting hole 421 at one end thereof that is fastened to the locating shank 412.

When assembling the outer shell member positioning device, insert the pivot pin 112 through the pivot holders 11 of the mounting base member 1, the pivot holes 212 of the bracket 2 and the torsion spring 113 to pivotally couple the bracket 2 to the mounting base member 1 and to have two opposite ends of the torsion spring 113 be respectively stopped against one constraint bar 22 of the bracket 2 and the bottom wall of the accommodation open chamber 10 of the mounting base member 1. At this time, the user can turn the bracket 2 about the pivot pin 11 to move the bracket 2 out of the accommodation open chamber 10 of the mounting base member 1. When the user releases the hand from the bracket 2 at this time, the elastic potential energy stored within the torsion spring 113 will immediately turn the bracket 2 back to its former position where the bracket 2 is tilted at angle relative to the accommodation open chamber 10 of the mounting base member 1 about the pivot pin 112.

Thereafter, insert the sliding hook member 3 into the sliding space 20 in the box track 23 of the bracket 2. At this time, the two first hook bars 32 will be squeezed inward by two opposite lateral sidewalls of the box track 23, i.e., the side panels 211 of the bracket 2, enabling the hooked tips 321 of the first hook bars 32 to be respectively moved into the two elongated sliding slots 231 of the box track 23 subject to the elastic properties of the material of the first hook bars 32. Subject to coupling between the hooked tips 321 of the first hook bars 32 and the two elongated sliding slots 231 of the box track 23, the sliding hook member 3 is slidably secured to the box track 23 of the bracket 2 and prohibited from falling out of the bracket 2. Further, after the bracket 2 and the sliding hook member 3 are received in the accommodation open chamber 10 of the mounting base member 1, the assembly exhibits low profile characteristics.

Thereafter, insert the lock cylinder 41 of the locking device 4 through the positioning hole 24 of the bracket 2 and the stub tube 242 to position the stop block 411 in the circularly arched sliding way 241 between the two stop edges 2411 in the positioning hole 24, and then mount the coiled spring 25 around the stub tube 242 to let two opposite ends of the coiled spring 25 be respectively stopped against the front side of the base plate 31 of the sliding hook member 3 and an inside wall of the box track 23 in the sliding space 20, and then fasten the mounting hole 421 of the locking latch 42 to the locating shank 412 of the lock cylinder 41 to let the locking latch 42 be rotatably stopped at the bottom side of the stub tube 242.

Figure 5:
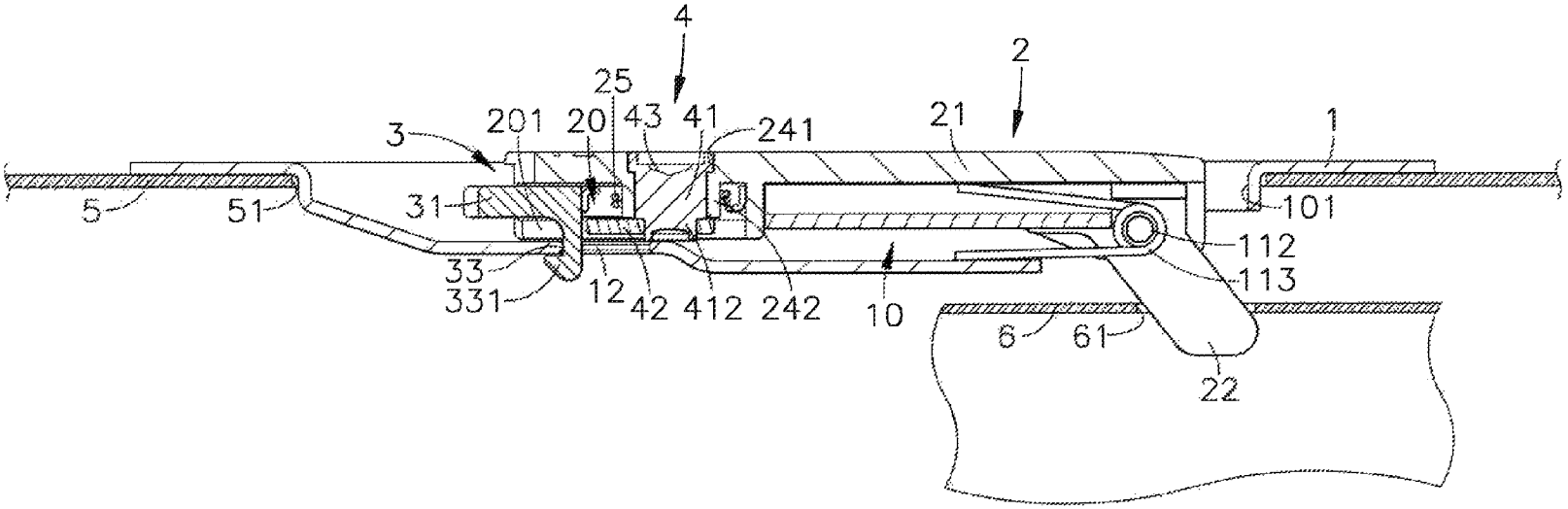
FIG. 5 is a schematic sectional applied view of the present invention, illustrating the outer shell member positioning device mounted in an outer shell member around an inner shell member.
Figure 6:
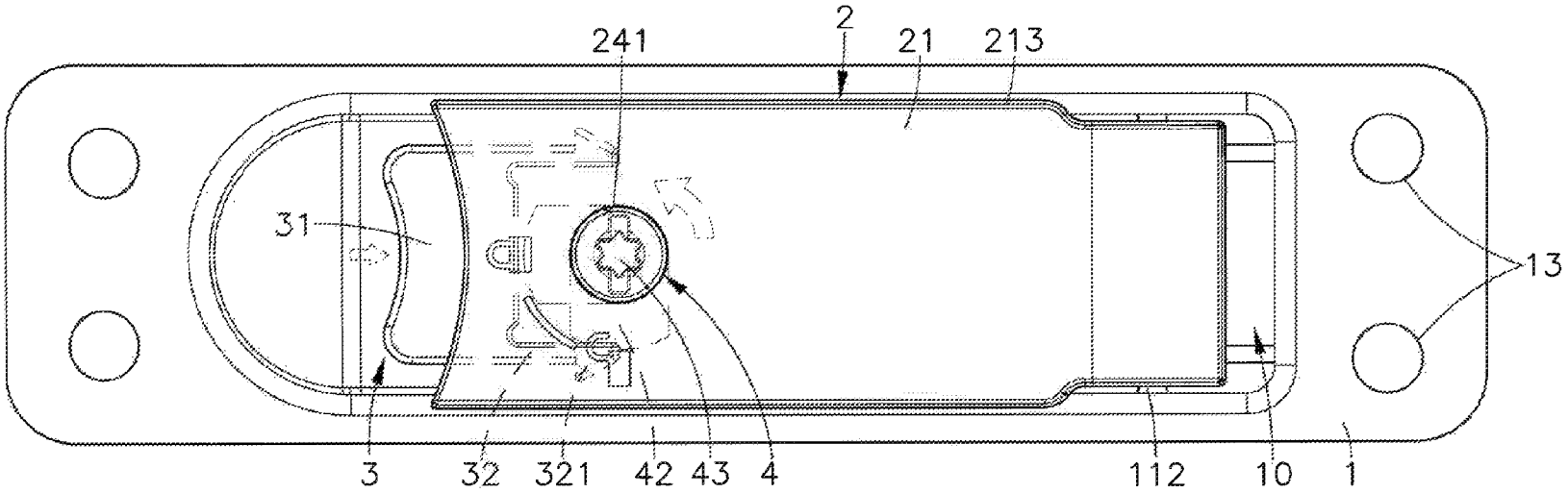
FIG. 6 is a schematic top view of the present invention, illustrating the locking device rotated from the locking position to the unlocking position.
Figure 7:
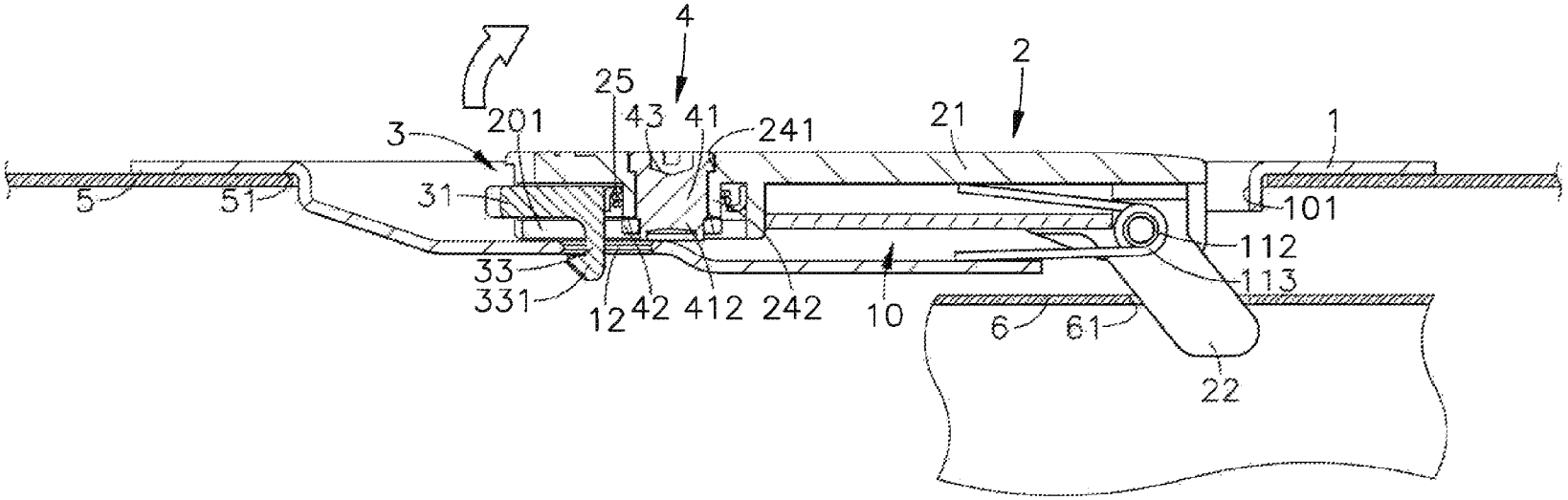
FIG. 7 is a schematic sectional side view, illustrating the outer shell member positioning device mounted in an outer shell member around an inner shell and kept in the locking position with the constraint bars of the bracket engaged in the locating hole of the inner shell member, FIG. 8 corresponds to FIG. 7, illustrating he outer shell member positioning device lifted from the outer shell and the inner shell member disengaged from the constraint of the constraint bars of the bracket of the outer shell member positioning device.
Figure 8:
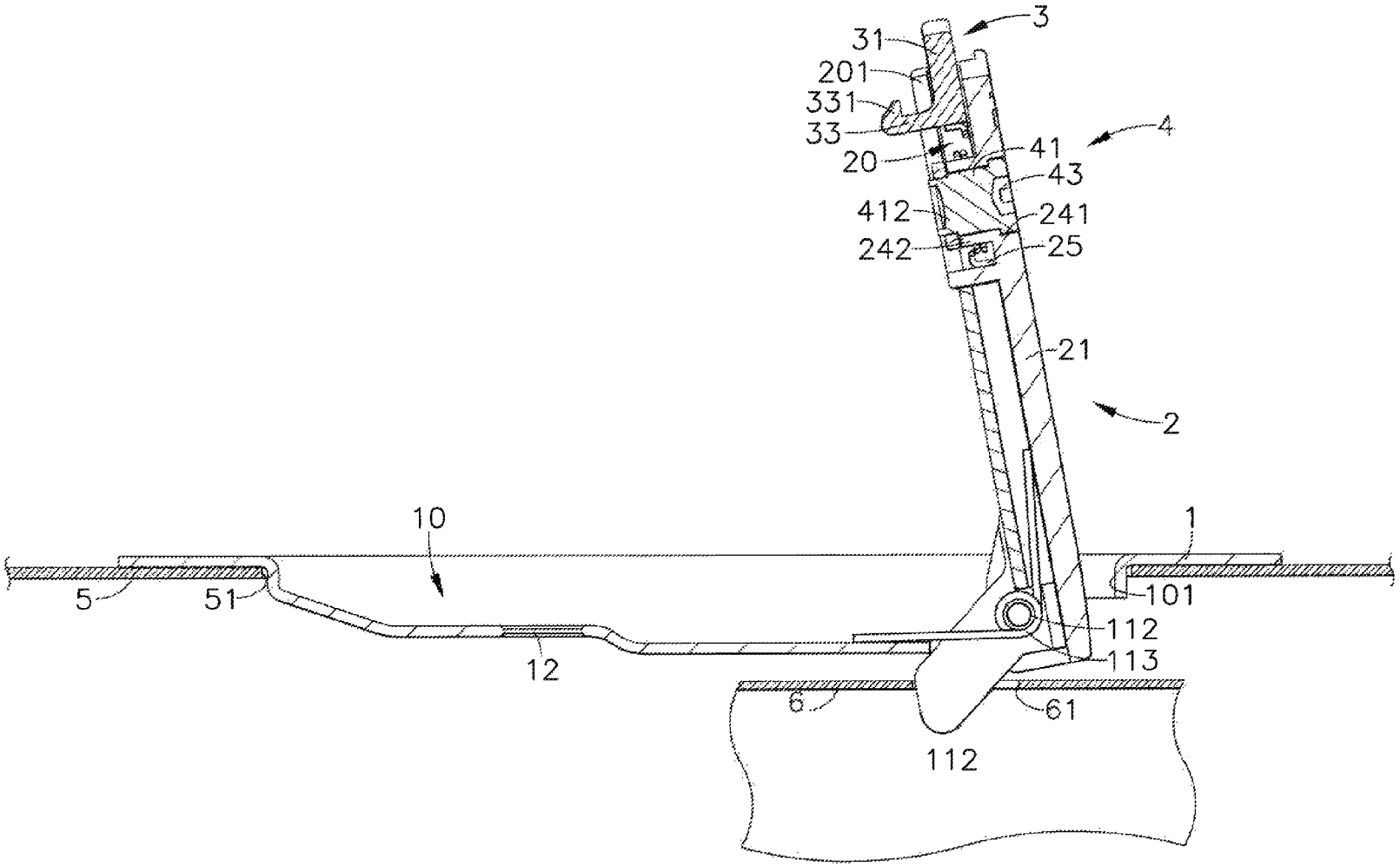

Referring to FIGS. 5-8, the outer shell member positioning device is adapted for mounting at an outer shell member 5 (for example, a server cabinet or computer housing) to secure an inner shell member 6 (for example, a server rack or mobile device case) that is put inside the outer shell member. During installation, affix the mounting through holes 13 of the mounting base member 1 of the outer shell member positioning device to the outer shell member 5 around an opening 51 in the outer shell member 5 using bolts, screws, rivets, or a welding technique, and then mount the inner shell member 6 in the outer shell member 5 for enabling the inner shell member 6 to be locked to the outer shell member 5 by the outer shell member positioning device.

During application of the present invention, insert a tool or key into the keyway 43, and then rotate the lock cylinder 41 of the locking device 4 through 90-degrees to move the stop block 411 in the circularly arched sliding way 241 from one stop edge 2411 in the positioning hole 24 to the other stop edge 2411, shifting the locking latch 42 from a locking position where the locking latch 42 is equally spaced between the two first hook bars 32 and stopped against the front side of the base plate 31 of the sliding hook member 3 to an unlocking position where the locking latch 42 extends in a direction perpendicular to the sliding direction of the sliding hook member 3 in the box track 23. Thereafter, push the base plate 31 of the sliding hook member 3 forward to move the two first hook bars 32 along the elongated sliding slots 231 of the box track 23 and to compress the coiled spring 25, and simultaneously to disengage the hooked tip 331 of the second hook bar 33 from the retaining hole 12 of the mounting base member 1, and then bias the sliding hook member 3 to turn the bracket 2 about the pivot pin 112 in direction away from the accommodation open chamber 10, moving the constraint bars 22 of the bracket 2 from a front side of the opening 101 of the mounting base member 1 to an opposite rear side of the opening 101 where the constraint bars 22 are released from the constraint of a locating hole 61 in the inner shell member 6. At this time, the outer shell member 5 is unlocked from the inner shell member 6 and can be separated from the inner shell member 6. Thus, it is convenient to dismount the outer shell member 5 from the inner shell member 6 with less effort.

When wishing to fasten the outer shell member 5 to the inner shell member 6, turn the bracket 2 about the pivot pin 112 in the reversed direction toward the inside of the accommodation open chamber 10 of the mounting base member 1 to let two opposite side edges 213 of the mounting base member 1 be stopped at the top wall of the mounting base member 1 around the accommodation open chamber 10. During movement of the bracket 2 toward the inside of the accommodation open chamber 10 of the mounting base member 1, the hooked tip 331 of the second hook bar 33 of the sliding hook member 3 is forced by the inside wall of the mounting base member 1 to move forward and then into the retaining hole 12. After hooking of the hooked tip 331 of the second hook bar 33 on the peripheral edge of the retaining hole 12, the constraint bars 22 of the bracket 2 are stopped against the peripheral edge of the locating hole 61 of the inner shell member 6 to prohibit pivoting motion between the bracket 2 and the mounting base member 1. Subject to engagement between the hooked tip 331 of the second hook bar 33 and the peripheral edge of the retaining hole 12, the constraint bars 22 of the bracket 2 are prohibited from being forced out of the locating hole 61 of the inner shell member 6 by a shearing force as the outer shell member 5 is being pulled accidentally by an external force.

Thereafter, the user can lock the outer shell member 5 to the inner shell member 6 by: rotating the lock cylinder 41 of the locking device 4 in the reversed direction through 90-degrees to move the locking latch 42 from the unlocking position to the locking position where the locking latch 42 is equally spaced between the two first hook bars 32 and stopped against the front side of the base plate 31 of the sliding hook member 3. At this time, the hooked tip 331 of the second hook bar 33 is firmly held in engagement with the peripheral edge of the retaining hole 12. Thus, the outer shell member 5 is locked to the inner shell member 6.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An outer shell member positioning device mountable at an outer shell member and adapted for locking an inner shell member to said outer shell member, comprising:

a mounting base member mountable at said outer shell member, said mounting base member comprising an elongated accommodation open chamber, pivoting means disposed adjacent to one end of said elongated accommodation open chamber, and a retaining hole disposed adjacent to an opposite end of said accommodation open chamber;

a bracket receivable in said elongated accommodation open chamber, said bracket comprising a base panel, two opposing constraint bars obliquely downwardly extended from said base panel and pivotally coupled to said pivoting means of said mounting base member and engageable into a locating hole in said inner shell member to lock said inner shell member to said outer shell member, a box track formed integral with said base panel at a location remote from said constraint bars, a sliding space defined in said box track, two elongated sliding slots respectively formed in two opposite lateral sides of said box track, and a positioning hole vertically cut through opposing top and bottom walls of said base panel in communication with said sliding space;

a sliding hook member comprising a base plate slidably inserted into said sliding space in said box track of said bracket, two first hook bars respectively and forwardly extended from two opposite lateral sides of said base plate and respectively coupled to said elongated sliding slots of said bracket, and a second hook bar downwardly extended from a front side of said base plate between said first hook bar and extending in a perpendicular direction relative to said first hook bars and adapted for hooking in said retaining hole to secure said bracket inside said elongated accommodation open chamber of said mounting base member; and a locking device comprising a lock cylinder mounted in said positioning hole of said bracket, and a locking latch fastened to said lock cylinder and rotatable with said lock cylinder relative to said bracket between a locking position where said locking latch is stopped against the front side of said base plate of said sliding hook member to hold said second hook bar of said sliding hook member in engagement with said retaining hole of said mounting base member and an unlocking position where said locking latch is released from the front side of said base plate of said sliding hook member for allowing movement of said sliding hook member relative to said bracket to disengage said second hook bar from said retaining hole of said mounting base member.

2. The outer shell member positioning device as claimed in claim 1, wherein said mounting base member further comprises an opening cut through a bottom wall thereof and disposed in communication with one end of said accommodation open chamber for the passing of said constraint bars; said pivoting means of said mounting base member comprises a pivot pin inserted through said constraint bars of said bracket to pivotally couple said bracket and said mounting base member together, and a torsion spring mounted on said pivot pin and stopped between said bracket and said mounting base member and adapted to impart a biasing force to said bracket to move said bracket out of said accommodation open chamber.

3. The outer shell member positioning device as claimed in claim 2, wherein said bracket comprises two side panels respectively downwardly extended from a bottom wall of said base panel and symmetrically disposed at two opposite lateral sides, two pivot holes respectively located in said side panels and pivotally coupled to said pivot pin of said mounting base member.

4. The outer shell member positioning device as claimed in claim 1, wherein said box track defines a bottom opening cut through a bottom wall thereof in communication with said sliding space for the passing of said second hook bar of said sliding hook member.

5. The outer shell member positioning device as claimed in claim 1, wherein said positioning hole defines therein two stop edges and a circularly arched sliding way between said two stop edges; said lock cylinder of said locking device further comprises a stop block located at the periphery thereof and movable in said circularly arched sliding way of said positioning hole between said two stop edges subject to movement of said locking latch with said lock cylinder between said locking position and said unlocking position.

6. The outer shell member positioning device as claimed in claim 1, wherein said bracket further comprises a stub tube vertically downwardly extended from the bottom wall of said base panel around said positioning hole and suspending in said sliding space, and a spring member mounted around said stub tube and having two opposite ends thereof respectively stopped against said base plate of said sliding hook member and an inside wall of said bracket inside said sliding space.

7. The outer shell member positioning device as claimed in claim 1, wherein each said first hook bar has a distal end thereof terminating in a hooked tip adapted for hooking in one said elongated sliding slot; said second hook bar has a distal end thereof terminating in a hooked tip adapted for hooking in said retaining hole of said mounting base member.

8. The outer shell member positioning device as claimed in claim 1, wherein said lock cylinder of said locking device comprises a locating shank located at a bottom side thereof; said locking latch of said locking device comprises a mounting hole located at one end thereof and fastened to said locating shank of said lock cylinder.

* * * * *